US006637645B2

(12) United States Patent
Ferguson

(10) Patent No.: US 6,637,645 B2
(45) Date of Patent: Oct. 28, 2003

(54) CONVERTIBLE BREAD PACKAGING PRODUCT FOR LOAF BREAD

(76) Inventor: Francis Eric Ferguson, 1254 Fern Hill Rd., Mooresville, NC (US) 28117

( * ) Notice: Subject to any disclaimer, the term of this patent is extended or adjusted under 35 U.S.C. 154(b) by 0 days.

(21) Appl. No.: 10/235,344

(22) Filed: Sep. 5, 2002

(65) Prior Publication Data

US 2003/0047594 A1 Mar. 13, 2003

Related U.S. Application Data

(63) Continuation-in-part of application No. 09/954,463, filed on Sep. 13, 2001, now abandoned.

(51) Int. Cl.[7] ..... B65D 5/36; B65D 5/42

(52) U.S. Cl. ..... 229/117; 229/117.35; 229/198

(58) Field of Search ..... 229/87.08, 87.09, 229/93, 117, 117.27, 117.35, 190, 198; 206/418; 383/119

(56) References Cited

U.S. PATENT DOCUMENTS

| | | | | |
|---|---|---|---|---|
| 2,527,692 A | | 10/1950 | Andrews | 229/87.08 |
| 2,676,750 A | | 4/1954 | Gastright | 229/117 |
| 2,798,596 A | | 7/1957 | Emmons | 206/418 |
| 3,079,059 A | | 2/1963 | Kuchenbecker | 229/190 |
| 3,331,550 A | | 7/1967 | Krzyzanowski | 229/93 |
| 3,385,502 A | * | 5/1968 | Pilger | 229/117.35 |
| 3,542,566 A | | 11/1970 | Wakefield | 383/119 |
| 3,750,933 A | | 8/1973 | Nicolay | 229/117 |
| 4,011,983 A | | 3/1977 | Greene | 229/198 |
| 4,230,261 A | | 10/1980 | Austin | 229/117 |
| 4,550,834 A | | 11/1985 | Fletcher et al. | 229/117 |
| 4,756,408 A | | 7/1988 | Grauf | 229/117 |
| 4,846,394 A | | 7/1989 | Swanson | 229/93 |
| 4,993,318 A | | 2/1991 | Bollinger | 229/117 |
| 5,042,714 A | | 8/1991 | Hall | 229/117 |
| 5,292,093 A | | 3/1994 | Shumake | 383/119 |
| 5,664,726 A | | 9/1997 | Opper | 229/117 |

FOREIGN PATENT DOCUMENTS

| | | | |
|---|---|---|---|
| AT | 233461 | 5/1964 | 229/117 |
| JP | 3/162240 A | 3/1991 | 206/459.5 |

* cited by examiner

*Primary Examiner*—Gary E. Elkins
(74) *Attorney, Agent, or Firm*—Adams Evans P.A.

(57) ABSTRACT

A convertible bread packaging product preserves loaf bread. The packaging product includes a foldable paperboard blank having first and second opposing end edges and first and second opposing side edges. The blank is folded along three lateral fold lines, and is attached along the first and second end edges to define a plurality of joined walls. The three lateral fold lines include a middle fold line and two outer fold lines. First and second spaced-apart scores are formed with the blank in a margin adjacent one of the first and second side edges. The first and second scores extend parallel to the side edge and intersect respective outer fold lines. The walls cooperate to form a protective enclosure having a length dimension greater than a width dimension, and at least one open end for receiving a loaf of bread. The enclosure is movable between a collapsed position for stacking the packaging product prior to use, and an open position for storing the loaf of bread during transport and handling. In the open position, diagonally opposed corners of the enclosure are folded inwardly at respective scores to rigidify the walls and to retain the loaf of bread within the enclosure.

11 Claims, 8 Drawing Sheets

CONVERTIBLE BREAD PACKAGING PRODUCT FOR LOAF BREAD

This application is a continuation-in-part of Ser. No. 09/954,463 Sep. 13, 2001, now abandoned.

TECHNICAL FIELD AND BACKGROUND OF THE INVENTION

This invention relates to a convertible bread packaging product for loaf bread. The invention is designed to preserve loaf bread during transport from the grocery store to the home. Prior to use, the invention is collapsed and arranged in a convenient stack at the point of sale for ready access by the cashier or grocery bagger. When loaf bread is purchased, the invention is removed from the stack and quickly converted from its collapsed condition to an open condition for receiving the loaf bread. The packaged bread is then placed inside a plastic or paper grocery bag along with other food items. The invention protects the bread from damage caused by other items which may fall against or lean into the bread, or which are placed on top of it.

SUMMARY OF THE INVENTION

Therefore, it is an object of the invention to provide a bread packaging product which is especially adapted to preserve loaf bread during transport from a retail grocery store to the home.

It is another object of the invention to provide a bread packaging product which can be conveniently stacked prior to use at the point of sale.

It is another object of the invention to provide a bread packaging product which is readily converted from a collapsed condition to an open condition for receiving the loaf bread.

It is another object of the invention to provide a bread packaging product which is constructed of recycled materials.

It is another object of the invention to provide a bread packaging product which has display surfaces for corporate logos, seasonal images, coupons, special promotions, notifications, missing children's pictures, and other advertising indicia.

It is another object of the invention to provide a bread packaging product which can be manufactured at relatively little cost.

These and other objects of the present invention are achieved in the preferred embodiments disclosed below by providing a convertible bread packaging product for preserving loaf bread. The packaging product includes a foldable paperboard blank having first and second opposing end edges and first and second opposing side edges. The blank is folded along three lateral fold lines, and is attached along the first and second end edges to define a plurality of joined walls. The three lateral fold lines include a middle fold line and two outer fold lines. First and second spaced-apart scores are formed with the blank in a margin adjacent one of the first and second side edges. The first and second scores extend parallel to the side edge and intersect respective outer fold lines. The walls cooperate to form a protective enclosure having a length dimension greater than a width dimension, and at least one open end for receiving a loaf of bread. The enclosure is movable between a collapsed position for stacking the packaging product prior to use, and an open position for storing the loaf of bread during transport and handling. In the open position, diagonally opposed corners of the enclosure are folded inwardly at respective scores to rigidify the walls and to retain the loaf of bread within the enclosure.

According to another preferred embodiment of the invention, a plurality of end flaps are formed along one side edge of the paperboard blank, and cooperate when folded to form a closed end of the protective enclosure.

According to another preferred embodiment of the invention, an adhesive is applied to at least one of the end flaps for joining at least two of the end flaps together.

According to another preferred embodiment of the invention, an attachment flange is formed with the first end edge of the paperboard blank, and is adapted for being attached to the second end edge of the paperboard blank.

According to another preferred embodiment of the invention, the attachment flange extends from one side edge of the paperboard blank to the other.

According to another preferred embodiment of the invention, a fold line is located between the first end edge and the attachment flange.

According to another preferred embodiment of the invention, the attachment flange has opposing ends each cut at an angle to the fold line to facilitate assembly of the packaging product.

According to another preferred embodiment of the invention, an adhesive is applied to the second end edge of the paperboard blank to join the second end edge to the attachment flange.

According to another preferred embodiment of the invention, the adhesive applied to the second end edge of the paperboard blank extends from one side edge to the other.

According to another preferred embodiment of the invention, the protective enclosure defines first and second opposing open ends.

In another embodiment, the invention is a convertible bread packaging product for preserving loaf bread. The packaging product includes a foldable paperboard blank having first and second opposing end edges and first and second opposing side edges. The blank is folded along three lateral fold lines extending respectively from one side edge to the other. The folded blank is attached at the first and second end edges to define four joined walls. The walls cooperate to form a rectangular enclosure having a length dimension greater than its width dimension, and at least one open end for receiving the loaf of bread. The enclosure is movable between a collapsed position for stacking the packaging product prior to use, and an open position for storing the loaf of bread during transport and handling.

In yet another embodiment, the invention is a method of preserving loaf bread. The method includes the step of placing a loaf of bread in a convertible bread packaging product including an enclosure movable between a collapsed position for stacking the packaging product prior to use, and an open position for receiving and storing the loaf of bread during transport and handling.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
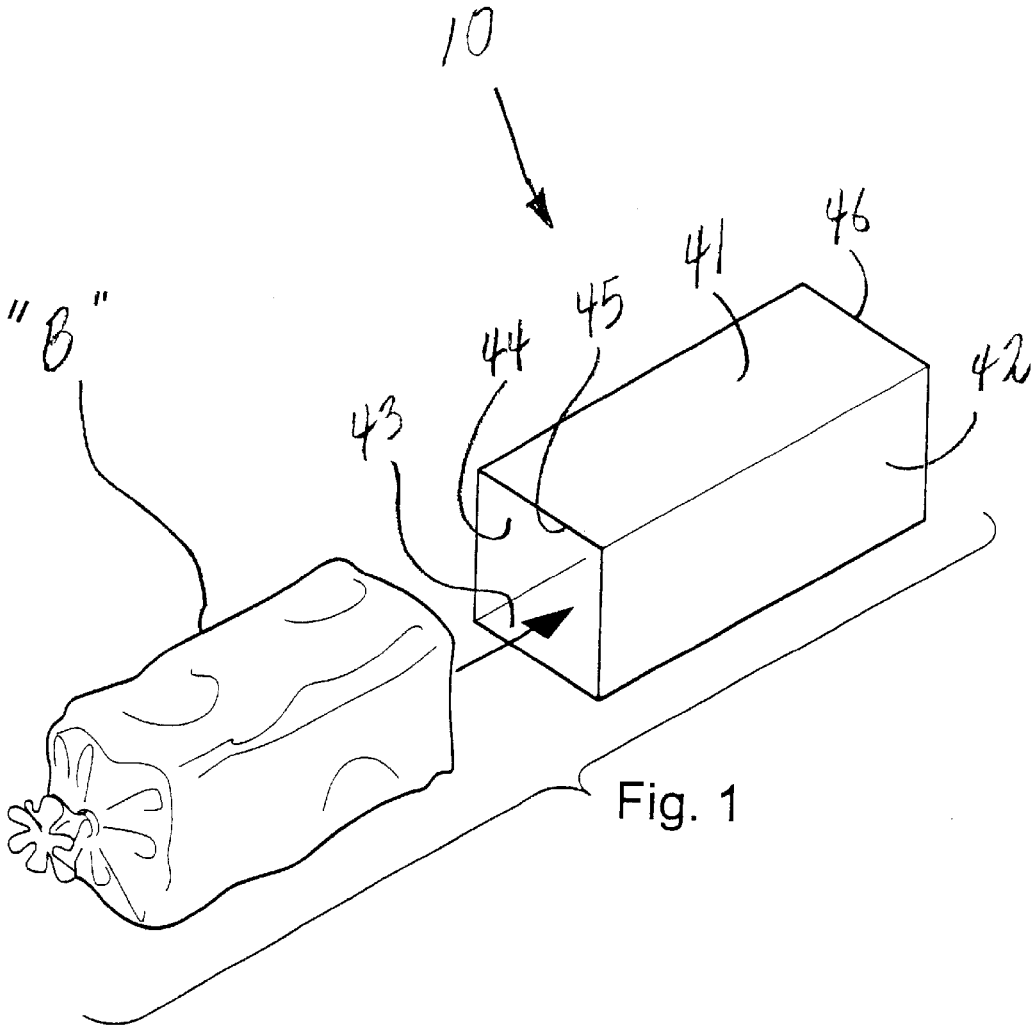
FIG. 1 is a perspective view of a bread packaging product according to one preferred embodiment of the present invention, and showing a loaf of sliced bread being inserted into the protective enclosure.

Referring now specifically to the drawings, a convertible bread packaging product according to the present invention is illustrated in FIG. 1 and shown generally at reference numeral 10. The packaging product 10 is especially applicable for preserving sliced, loaf bread during transport from a retail grocery store to home. The packaging product 10 converts between an open condition, shown in FIG. 1, for receiving and storing loaf bread "B", and a collapsed condition, shown in FIGS. 2 and 6, for stacking prior to use.

Figure 3:
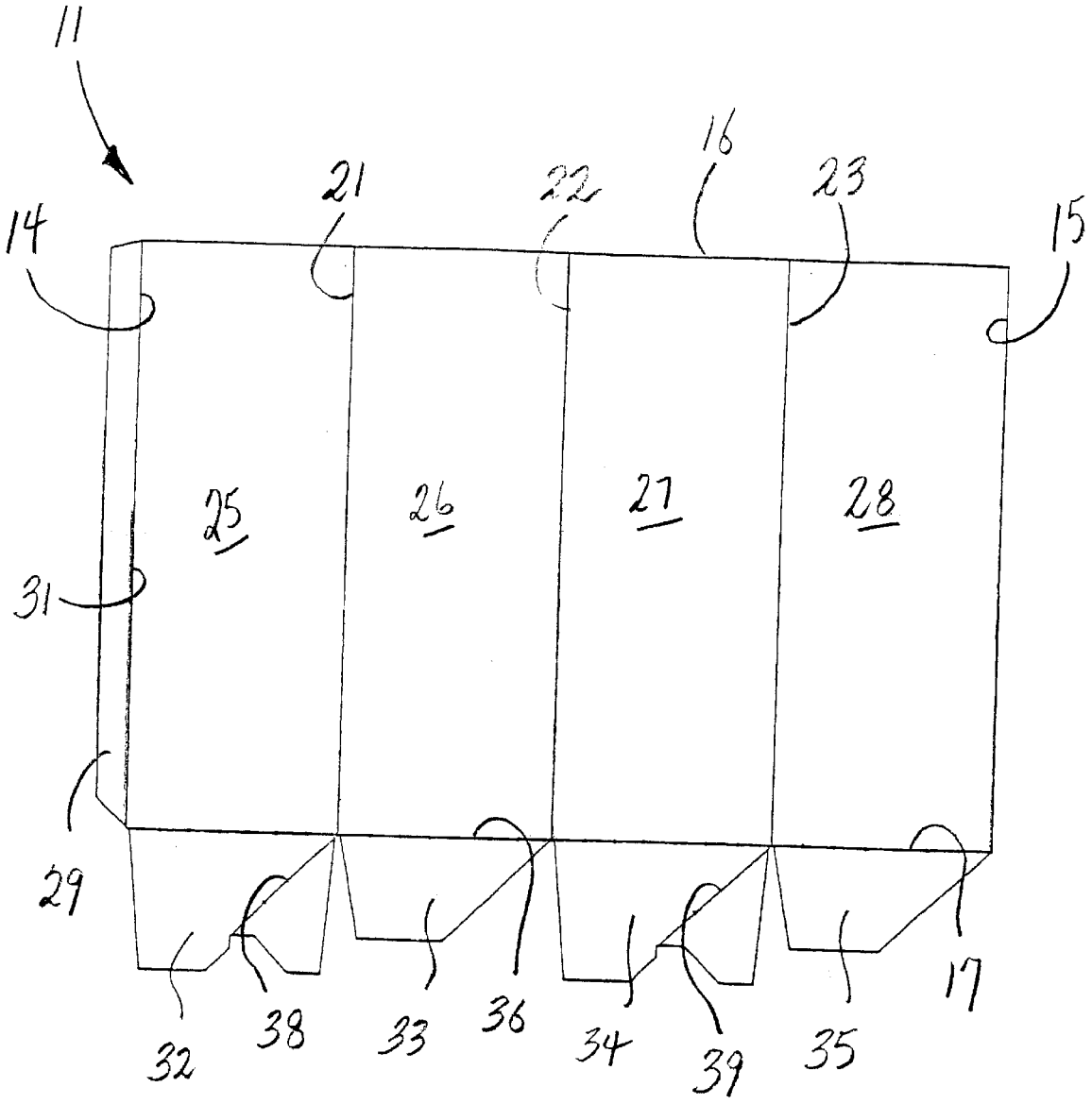
FIG. 3 is a plan view of the paperboard blank prior to folding.

Referring to FIG. 3, the packaging product 10 is constructed from a foldable paperboard blank 11 having opposing end edges 14 and 15 and opposing side edges 16 and 17. The blank 11 is preferably formed of 0.024 CCKB sheet stock. Lateral fold lines 21, 22, and 23 extend from one side edge 16, 17 of the blank 11 to the other, and define a number of joined rectangular panels 25, 26, 27, and 28. An attachment flange 29 is integrally-formed with the end edge 14 adjacent the panel 25, and along an end edge fold line 31. End closure flaps 32, 33, 34, and 35 are integrally-formed with respective panels 25, 26, 27, and 28 at side edge 17 of the blank 11, and along a common side edge fold line 36. End closure flaps 32 and 34 include respective hinges 38 and 39.

Folding the Blank 11

Preferably, the paperboard blank 11 is folded in an automatic folding machine. The first fold is made along the lateral fold line 21 to position the panel 25 ninety degrees to the adjacent panel 26. End closure flaps 32 and 33 are then folded upwardly ninety degrees to the panels 25 and 26 such that end closure flap 32 resides outside the overlying smaller flap 33. The end closure flaps 32 and 33 are attached together using an adhesive. The blank 11 is then folded along the lateral fold line 23 to position the panel 28 ninety degrees to the adjacent panel 27. End closure flaps 34 and 35 are folded upwardly ninety degrees to the panels 27 and 28, and are attached together using an adhesive. End closure flap 34 resides outside the overlying smaller flap 35. The final fold is made at fold line 22 to bring the opposing end edges 14 and 15 of the blank 11 together. The attachment flange 29 is attached to the end edge 15 using an adhesive. The adhesive used to assemble the folded blank 11 is preferably a water-soluble, FDA approved adhesive, such as that sold by Capital Adhesives of Mooresville, Ind.

Figure 4:
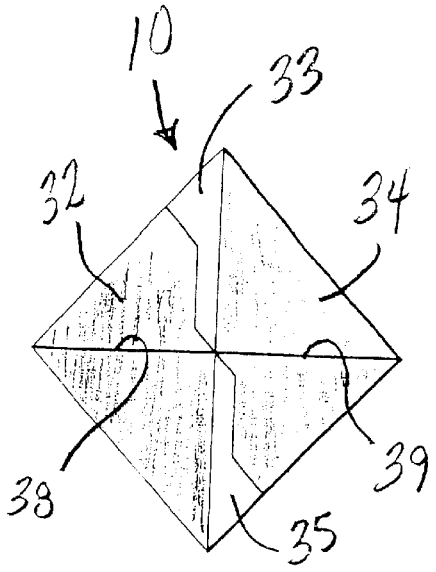
FIGS. 4, 5, and 6 are sequential end views of the bread packaging product being moved from the open condition, shown in FIG. 4, to the collapsed condition, shown in FIG. 6.
Figure 5:
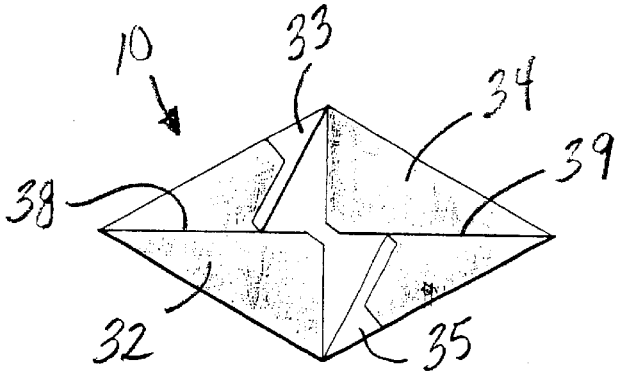
Figure 6:
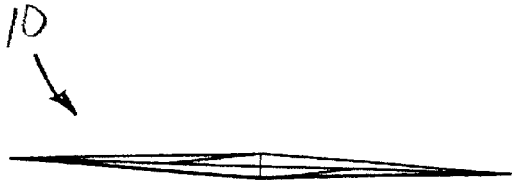

Referring again to FIG. 1, the above folding process results in a protective enclosure defined by joined walls 41, 42, 43, and 44, and having an open end 45 shaped for receiving a single loaf of sliced bread "B" and an opposing closed end 46. The closed end 46 is pivotable inwardly at respective hinges 38 and 39 to allow movement of the packing product 10 between the collapsed condition and the open condition. FIGS. 4, 5, and 6 demonstrate conversion of the packaging product 10 from the open condition to the collapsed condition. The larger end closure flaps 32 and 34 are shaded for clarity.

Figure 2:
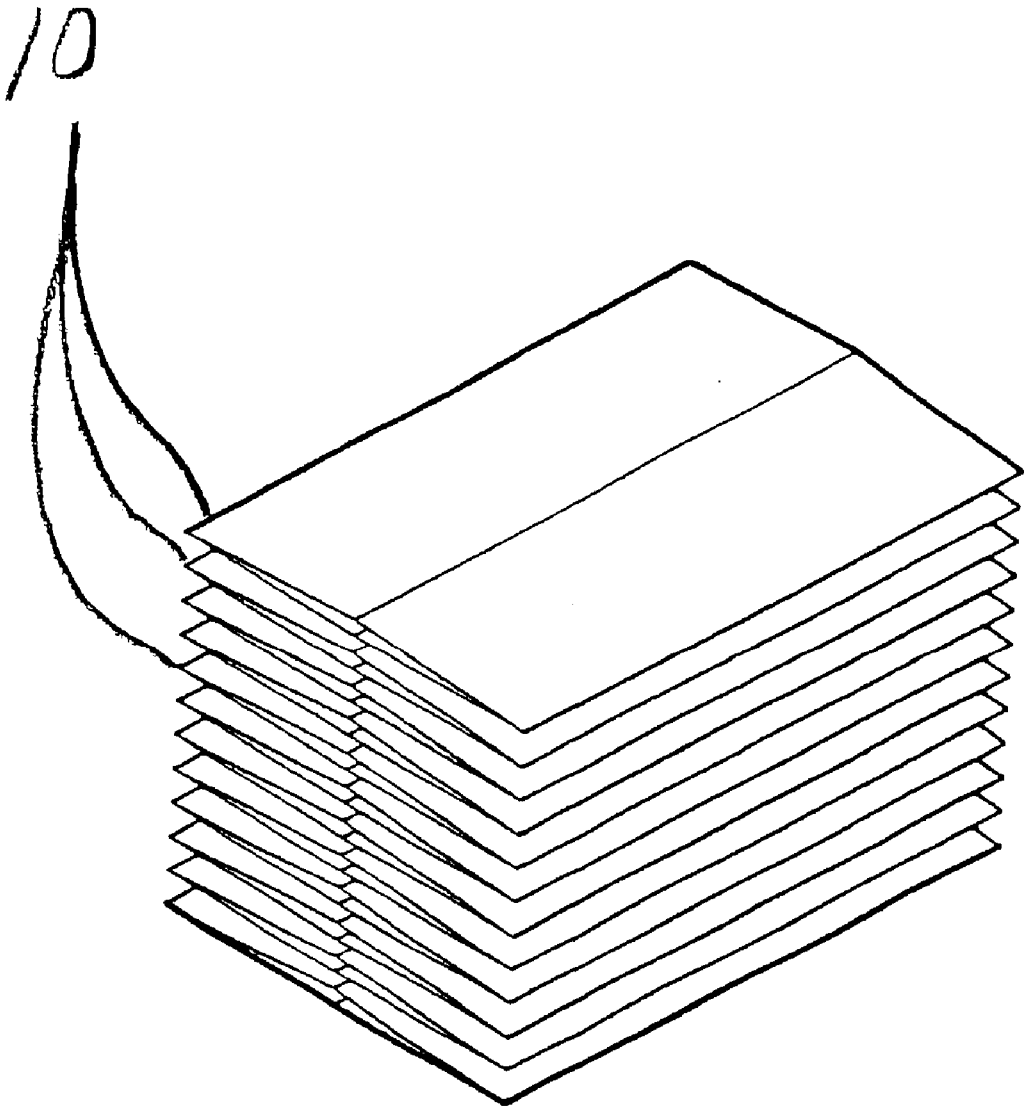
FIG. 2 is perspective view of the bread packaging product in a collapsed condition, and arranged with a number of like products in a stack.

When loaf bread is purchased, the cashier or grocery bagger removes a single packaging product 10 from a stack, such as shown in FIG. 2, and quickly converts the packaging product at the point of sale from the collapsed condition to the open condition by pressing gently inwardly on opposing outside edges. Once opened, the bread "B" is inserted into the packaging product 10 through its open end 45. The packaged bread is then placed inside a grocery bag for safe transport. Preferably, the packaging product 10 is sufficiently strong to support a uniform load of as much as 5–8 pounds, although greater loads may be placed on or against the product without damaging the bread.

Figure 7:
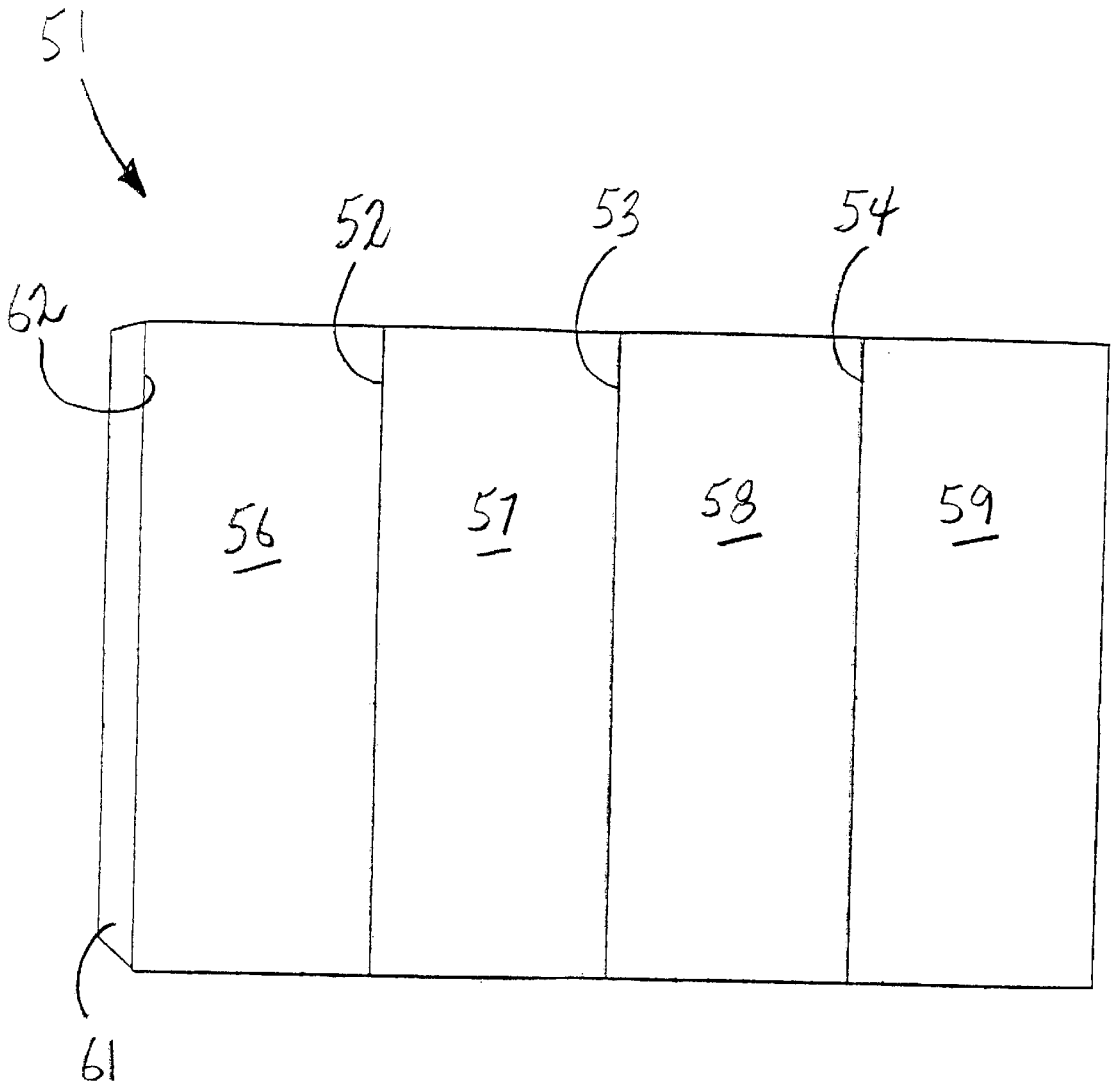
FIG. 7 is a plan view of a paperboard blank according to a second preferred embodiment of the invention.
Figure 8:
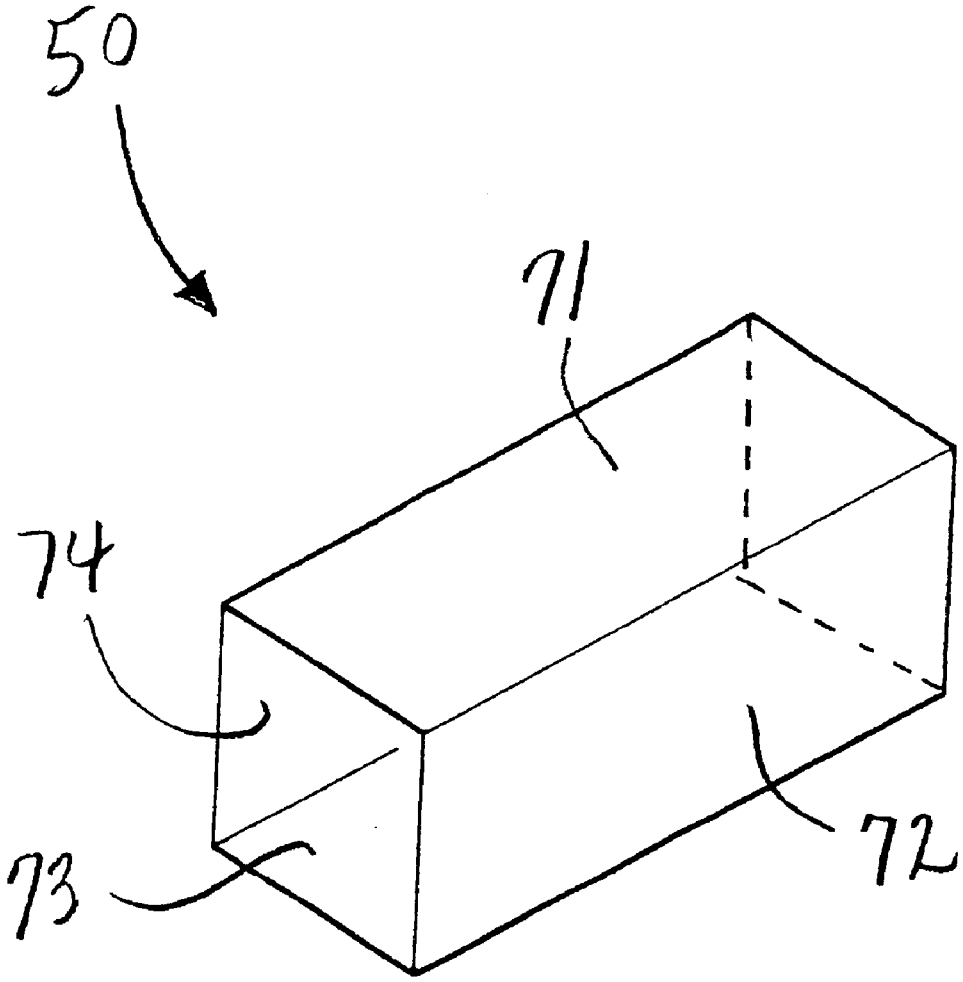
FIG. 8 is a perspective view of a bread packaging product constructed from the blank shown in FIG. 7.

In a further embodiment shown in FIGS. 7 and 8, the convertible bread packaging product 50 is constructed of a foldable paperboard blank 51 with no end closure flaps. The blank 51 includes lateral fold lines 52, 53, and 54 extending from one side edge to the other, and defining a number of joined rectangular panels 56, 57, 58, and 59. An attachment flange 61 is integrally-formed with one end edge adjacent the panel 56, and along an end edge fold line 62.

The paperboard blank 51 is preferably folded in an automatic folding machine. The first fold is made along the lateral fold line 52 to position the panel 56 ninety degrees to the adjacent panel 57. The blank 51 is then folded along the lateral fold line 54 to position the panel 59 ninety degrees to the panel 58. The final fold is made at fold line 53 to bring the opposing end edges of the blank 51 together. The attachment flange 61 is attached to the end edge using a water-soluble, FDA approved adhesive. The resulting packaging product 50, shown in FIG. 8, forms an open-ended protective sleeve defined by joined walls 71, 72, 73, and 74 for receiving and preserving a single loaf of bread during transport and handling. The packaging product 50 is moveable between a collapsed condition and an open condition, as previously described.

Figure 9:
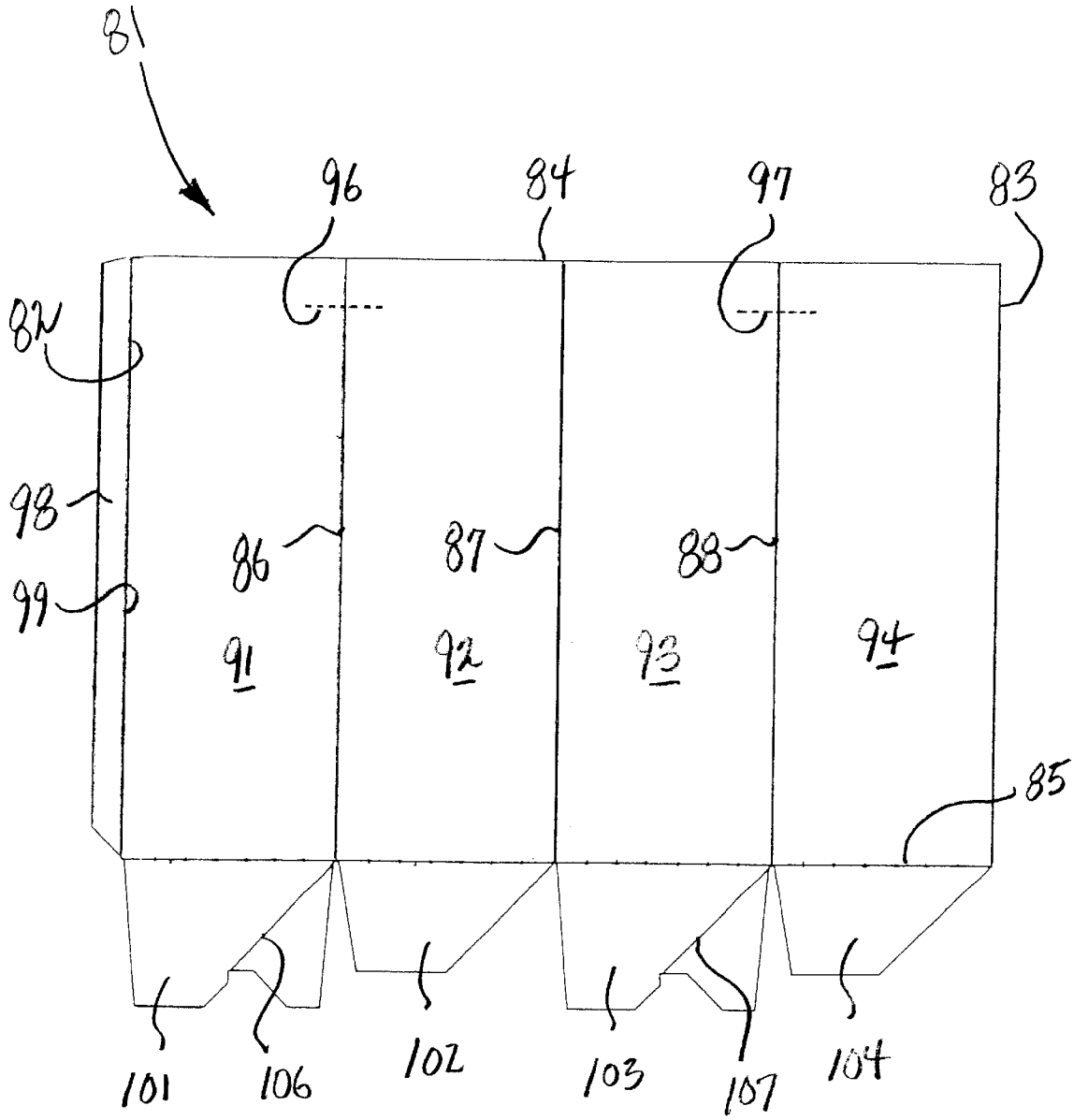
FIG. 9 is a plan view of a paperboard blank according to a further preferred embodiment of the invention.
Figure 10:
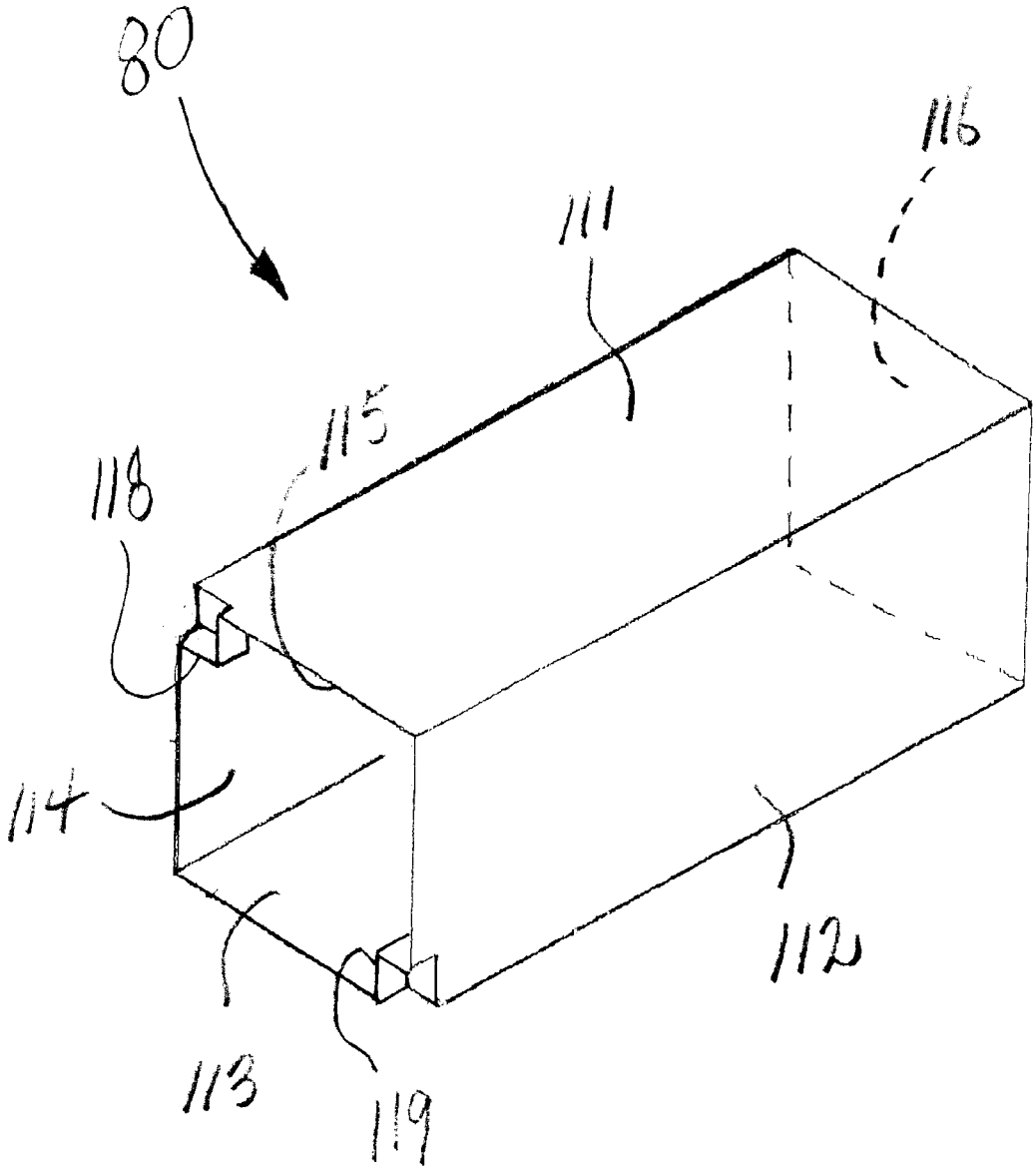
FIG. 10 is a perspective view of a bread packaging product constructed from the blank shown in FIG. 9.

In yet another embodiment shown in FIGS. 9 and 10, the packaging product 80 is constructed from a foldable paperboard blank 81 having opposing end edges 82 and 83 and opposing side edges 84 and 85. Lateral fold lines 86, 87, and 88 extend from one side edge 84 of the blank 81 to the other side edge 85, and define a number of joined rectangular panels 91, 92, 93, and 94. First and second spaced-apart scores 96 and 97 are formed with the blank 81 in a margin adjacent the side edge 84. Each of the scores 96, 97 extends parallel to the side edge 84 and intersects respective outer lateral fold lines 86 and 88. An attachment flange 98 is integrally-formed with the end edge 82 adjacent the panel 91, and along an end edge fold line 99. End closure flaps 101, 102, 103, and 104 are integrally-formed with respective panels 91, 92, 93, and 94 at side edge 85 of the blank 81, and along a common side edge fold line 105. End closure flaps 101 and 103 include respective hinges 106 and 107.

The packaging product 80 is formed by a first fold made along the outer lateral fold line 86 to position the panel 91 ninety degrees to the adjacent panel 92. End closure flaps 101 and 102 are then folded upwardly ninety degrees to the panels 91 and 92 such that end closure flap 101 resides outside the overlying smaller flap 102. The end closure flaps 101 and 102 are attached together using an adhesive. The blank 81 is then folded along the outer lateral fold line 88 to position the panel 94 ninety degrees to the adjacent panel 93. End closure flaps 103 and 104 are folded upwardly ninety degrees to the panels 93 and 94, and are attached together using an adhesive. End closure flap 103 resides outside the overlying smaller flap 104. The final fold is made at the middle fold line 87 to bring the opposing end edges 82 and 83 of the blank 81 together. The attachment flange 98 is attached to the end edge 83 using an adhesive. As shown in FIG. 10, this process results in a protective enclosure defined by joined walls 111, 112, 113, and 114, and having an open end 115 shaped for receiving a single loaf of sliced bread and an opposing closed end 116. After the bread is inserted into the enclosure, diagonally opposed corners 118 and 119 of the enclosure are folded inwardly at respective scores 96 and 97 to rigidify the walls 111–114 and to retain the loaf of bread within the enclosure. The resulting reinforcement adds rigidity to the walls 111–114 and serves to retain the loaf of bread within the enclosure.

A convertible bread packaging product for loaf bread is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A convertible bread packaging product for preserving loaf bread, said packaging product comprising:

(a) a foldable paperboard blank having first and second opposing end edges and first and second opposing side edges, said blank being folded along three lateral fold lines and attached along said first and second end edges to define a plurality of joined walls, said three lateral fold lines comprising a middle fold line and two outer fold lines;

(b) first and second spaced-apart scores formed with said blank in a margin adjacent one of said first and second side edges, and said first and second scores extending parallel to said side edge and intersecting respective outer fold lines; and (c) said walls cooperating to form a protective enclosure having a length dimension greater than a width dimension thereof, and at least one open end for receiving a loaf of bread therein, said enclosure being movable between a collapsed position for stacking said packaging product prior to use, and an open position for storing the loaf of bread during transport and handling, whereby in the open position, diagonally opposed corners of said enclosure are folded inwardly at respective scores to rigidify said walls and to retain the loaf of bread within said enclosure.

2. A bread packaging product according to claim 1, and comprising a plurality of end flaps formed along one side edge of said paperboard blank, and cooperating when folded to form a closed end of said protective enclosure.

3. A bread packaging product according to claim 2, and comprising an adhesive applied to at least one of said end flaps for joining at least two of said end flaps together.

4. A bread packaging product according to claim 1, and comprising an attachment flange formed with the first end edge of said paperboard blank, and adapted for being attached to the second end edge of said paperboard blank.

5. A bread packaging product according to claim 4, wherein said attachment flange extends from one side edge of said paperboard blank to the other.

6. A bread packaging product according to claim 4, and comprising a fold line between said first end edge and said attachment flange.

7. A bread packaging product according to claim 4, wherein said attachment flange has opposing ends each cut at an angle to said fold line to facilitate assembly of said packaging product.

8. A bread packaging product according to claim 4, and comprising an adhesive applied to one of the second end edge of said paperboard blank and said attachment flange to join the second end edge and said attachment flange together.

9. A bread packaging product according to claim 8, wherein the adhesive applied to one of the second end edge of said paperboard blank and said attachment flange extends from one side edge to the other.

10. A bread packaging product according to claim 1, wherein said protective enclosure defines first and second opposing open ends.

11. A convertible bread packaging product for preserving loaf bread, said packaging product comprising:

(a) a foldable paperboard blank having first and second opposing end edges and first and second opposing side edges, and a plurality of end flaps formed along said first side edge;

(b) said blank being folded along three lateral fold lines and attached along said first and second end edges to define a plurality of joined walls, said three lateral fold lines comprising a middle fold line and two outer fold lines;

(c) first and second spaced-apart scores formed with said blank in a margin adjacent to said second side edge, and said first and second scores extending parallel to said second side edge and intersecting respective outer fold lines; and (d) said walls cooperating to form a protective enclosure having a length dimension greater than a width dimension thereof, and an open end for receiving a loaf of bread therein, and said end flaps cooperating when folded to form a closed end of said enclosure, said end flaps comprising a first end flap having converging side edge sections and an end edge section, said end edge section defining a first horizontal portion, a first diagonal portion extending inwardly from said first horizontal portion, a second horizontal portion extending from said first diagonal portion, a first vertical portion extending outwardly from said second horizontal portion, a second diagonal portion extending outwardly from said first vertical portion, and a third horizontal portion extending from said second diagonal portion, and said end flaps further comprising a second end flap having converging side edge sections and an end edge section, said enclosure being movable between a collapsed position for stacking said packaging product prior to use, and an open position for storing the loaf of bread during transport and handling, whereby in the open position, diagonally opposed corners of said enclosure are folded inwardly at respective scores to rigidify said walls and to retain the loaf of bread within said enclosure.

* * * * *